US007010820B1

(12) United States Patent
Veravanich

(10) Patent No.: US 7,010,820 B1
(45) Date of Patent: Mar. 14, 2006

(54) NURSING AID DEVICE AND METHODS OF USE

(76) Inventor: Carol Ann Veravanich, 25075 Portsmouth, Mission Viejo, CA (US) 92692

( * ) Notice: Subject to any disclaimer, the term of this patent is extended or adjusted under 35 U.S.C. 154(b) by 0 days.

(21) Appl. No.: 11/049,273

(22) Filed: Feb. 1, 2005

(51) Int. Cl.
*A61G 9/00* (2006.01)

(52) U.S. Cl. ..... 5/655; 5/636; 5/632

(58) Field of Classification Search ..... 5/655, 5/630, 632, 636, 639, 643, 652; D6/601; 128/845
See application file for complete search history.

(56) References Cited

U.S. PATENT DOCUMENTS

| | | | | |
|---|---|---|---|---|
| 5,261,134 | A | 11/1993 | Matthews | |
| 5,546,620 | A | 8/1996 | Matthews | |
| 6,006,381 | A * | 12/1999 | Tandrup | 5/655 |
| 6,038,720 | A | 3/2000 | Matthews | |
| 6,055,687 | A | 5/2000 | Matthews | |
| 6,279,185 | B1 | 8/2001 | Matthews | |
| 6,321,403 | B1 | 11/2001 | Matthews | |
| 6,412,128 | B1 | 7/2002 | Matthews | |
| 6,434,770 | B1 | 8/2002 | Matthews-Brown | |
| 6,453,493 | B1 | 9/2002 | Matthews-Brown | |
| 6,523,200 | B1 | 2/2003 | Brown | |
| 6,532,612 | B1 | 3/2003 | Matthews-Brown | |
| 6,625,828 | B1 | 9/2003 | Matthews-Brown | |
| 6,640,977 | B1 | 11/2003 | Matthews-Brown | |
| 6,651,282 | B1 * | 11/2003 | Skoug et al. | 5/655 |
| 6,671,908 | B1 | 1/2004 | Brown | |
| 6,685,024 | B1 | 2/2004 | Matthews | |
| 2001/0008214 | A1 | 7/2001 | Matthews | |
| 2002/0042953 | A1 | 4/2002 | Matthews-Brown | |
| 2003/0217950 | A1 | 11/2003 | Matthews-Brown | |
| 2004/0060116 | A1 | 4/2004 | Matthews-Brown | |
| 2004/0154104 | A1 | 8/2004 | Matthews-Brown | |
| 2004/0200004 | A1 | 10/2004 | Matthews-Brown | |

* cited by examiner

*Primary Examiner*—Alexander Grosz
(74) *Attorney, Agent, or Firm*—Polaphat Veravanich

(57) ABSTRACT

The present invention provides an nursing aid device and methods of using the device to provide support over a Cesarian section incision while also providing support for the mother's arm while nursing in a chair or in a bed. The shape of the nursing aid device acts like a substitute "lap" for the mother and the nursing aid device is configured to tuck under her arm for comfortable nursing sessions. The nursing aid device may include a covering having a short length, a long length opposite the short length, and a wing on each end of the long length. The covering may define a trapezoidal shape or a triangular shape, and may include a plurality of undulating curves on an outer periphery. The nursing aid device is designed to fit within or on a mother's lap, rather than around her torso.

5 Claims, 4 Drawing Sheets

NURSING AID DEVICE AND METHODS OF USE

FIELD OF THE INVENTION

The present invention relates to improved nursing aid devices and methods of use, and also to an improved nursing aid device designed for use after a Cesarian section and methods for using the same.

BACKGROUND

After giving birth, new mothers typically require the use of a pillow to support the infant while nursing. This need is particularly acute when mothers give birth by Cesarian section. Currently, one out of every four births is performed by Cesarian section procedures. With a Cesarian section, the incision used to access the uterus is extremely sensitive and tender as a result of the surgical procedure, and mothers who give birth by this procedure require a flat support over this area so that the baby lies comfortably. For example, the baby often kicks and snuggles, and recovering mothers need a nursing pillow to prevent the baby from injuring the incision area.

The nursing pillows currently on the market are shaped in a half circle, or a half donut, that wraps around the midsection of the mother. Not all mothers desire a nursing pillow that is designed to wrap around their midsections. Furthermore, many of these mothers are unable to properly position the pillow due to the weight and bulk of the pillow. Additionally, the size of the current nursing pillows prevent comfortable use of the pillows in many chairs such as glider and rocking chairs. As shown in FIG. 1, the size of the current pillows (PA) prevents the pillows from resting on the mother's incision when the mother is sitting in a glider or rocking chair. Not only are the current pillows unsuitable for optimal use with glider or rocking chairs, when a mother uses one of these pillows while sitting in a glider or rocking chair, the pillow fails to cover the incision and also places the baby at a position that is too high for nursing.

The current nursing pillows are also designed to support babies as they learn to sit up because the pillows are firm and provide support for the babies. With Cesarian sections, however, these pillows are disadvantageous due to the heavy weight and firm nature of the pillows that are necessary to provide support for the babies. For example, mothers who give birth by Cesarian section are instructed to not lift heavy items.

Therefore, there is a long-felt but unmet need for an improved nursing aid device that may be used comfortably over a Cesarian section incision.

There is also a long-felt but unmet need for an improved nursing aid device suitable for use in a wide range of chairs, including glider chairs and rocking chairs.

SUMMARY OF THE INVENTION

The present invention provides for support over a Cesarian section incision while also providing support for the mother's arm while nursing in a chair or in a bed, while nursing the child is positioned on top of the nursing aid device. The shape of the nursing aid device acts like a substitute "lap" for the mother and the nursing aid device is configured to tuck under her arm for comfortable nursing sessions. When other children are around the mother, the mother may also use the nursing aid device for defense and comfort. Also, after a Cesarian section procedure, mothers often experience increased levels of discomfort when coughing, sneezing, or laughing due to increased tension being placed on the stitches closing the incision. In these the situations the nursing aid device may be positioned in the mother's lap with the nursing aid device covering the incision device. The mother may then use the nursing aid device to decrease the tension exerted on the incision. Other nursing pillows are unsuitable for such uses.

In one aspect of the present invention, a nursing aid device is provided. The nursing aid device includes a covering. The covering includes a short length, a long length opposite the short length, and a wing on each end of the long length. The nursing aid device also includes a filling within the covering, with the filling being a substantially soft material such as polyester fiberfill, cotton, and the like. The covering may define a trapezoidal shape or a triangular shape. The covering may also include a plurality of undulating curves on an outer periphery. The covering may be constructed from fleece, cotton, polyester, and the like.

The present invention also provides for a method of using a nursing aid device having a covering with a short length, a long length opposite the short length, and a wing on each end of the long length, and a filling comprising a soft material within the covering. The nursing aid device is placed on a mother's lap. The short length of the nursing aid device is positioned over a Cesarian section incision, and the long length of the nursing aid device is positioned across the mother's stomach and under the mother's arm. The mother's arm is supported with the nursing aid device while nursing a child. This method may include distributing the child's weight across the incision using the nursing aid device.

The present invention provides for another method of using a nursing aid device. The nursing aid device, which includes a covering having a short length, a long length opposite the short length, and a wing on each end of the long length, and a filling comprising a soft material within the covering, is placed on a mother's lap. The long length of the nursing aid device is positioned over the Cesarian section incision, and the short length is oriented towards the mother's chest. While nursing, the child's back is support with the nursing aid device while holding the child within the crook of the mother's arm.

Other objects and features of the present invention will become apparent from consideration of the following description taken in conjunction with the accompanying drawings.

DETAILED DESCRIPTION

The present invention provides for nursing aid devices specifically designed for use by mothers who have given birth via Cesarian section. The present invention also provides for methods for using the improved nursing aid devices.

Figure 1:
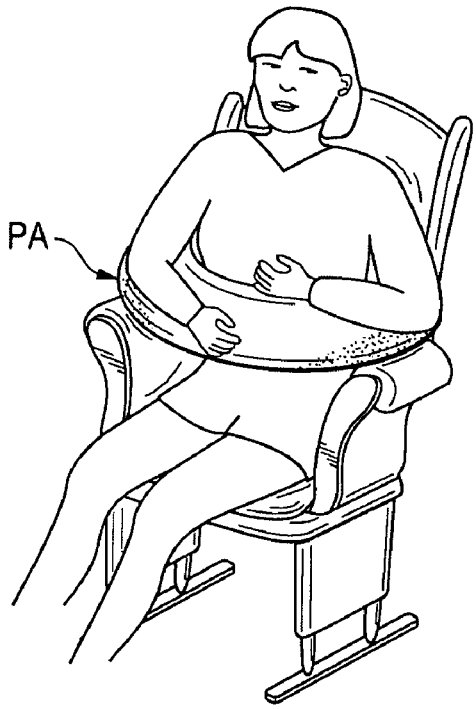
FIG. 1 (PRIOR ART)
FIG. 1 illustrates the use of a prior art nursing pillow.
Figure 2:
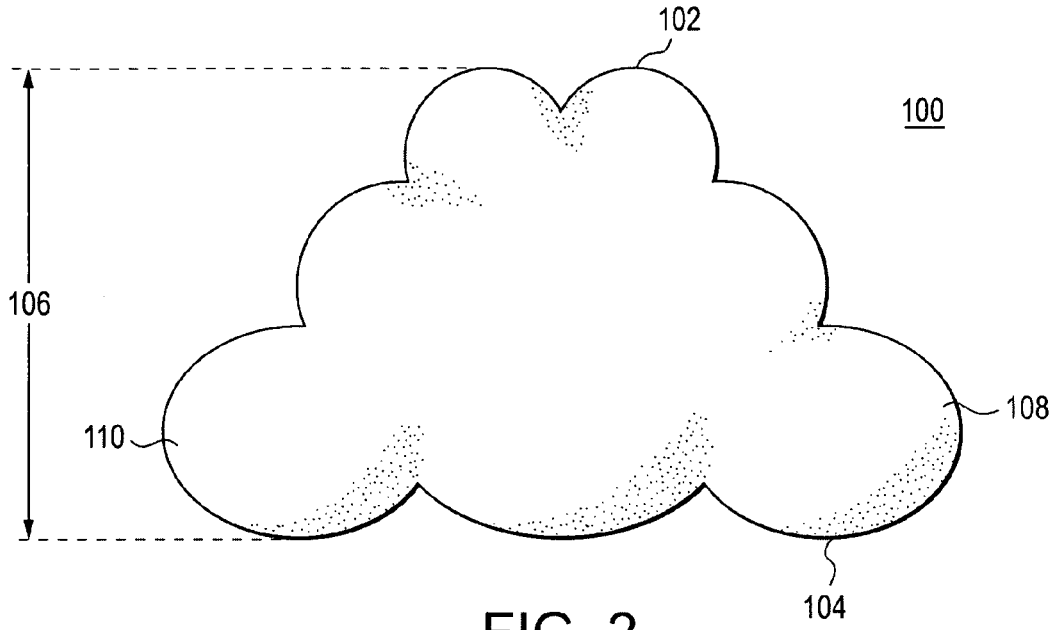
FIG. 2 illustrates an embodiment of a nursing aid device of the present invention.

Turning to FIG. 2, an improved nursing aid device 100 of the present invention is illustrated. The nursing aid device 100 may be trapezoidal or triangular in shape, and has an outer covering of suitable soft material, such as, e.g., fleece material, cotton, polyester, and the like. The nursing aid device 100 is filled with a material that results in a nursing aid device 100 that is soft and firm, but also very light compared to prior art nursing pillows. The nursing aid device 100 must be light in comparison to prior art nursing pillows in order to allow the nursing aid device 100 to be comfortably placed over a Cesarian section incision. Suitable materials usable to fill the nursing aid device 100 include, but is not limited to, polyester fiberfill, cotton, and the like.

As noted, the nursing aid device 100 is preferably trapezoidal in shape. Accordingly, a short length 102 of the nursing aid device 100 has a smaller length than a long length 104 of the nursing aid device 100. For example, in one embodiment the short length 102 of the nursing aid device 100 may measure approximately 10 inches in length while the long length 104 of the nursing aid device 100 may measure approximately 20 inches in length. With this embodiment, the short length 102 and the long length 104 are generally parallel to each other. Additionally, the long length 104 defines first and second wings 108, 110 of the nursing aid device 100.

The width 106 of the nursing aid device 100 between the short length 102 and the long length 104 may be approximately 12 inches, and the nursing aid device 100 may be approximately 5 to 6 inches deep or thick. Preferably, the depth or thickness of the nursing aid device 100 is such that the mother's arm may comfortably rest on the nursing aid device 100 while the nursing aid device 100 still provides support on top of the incision for the baby.

Figure 4:
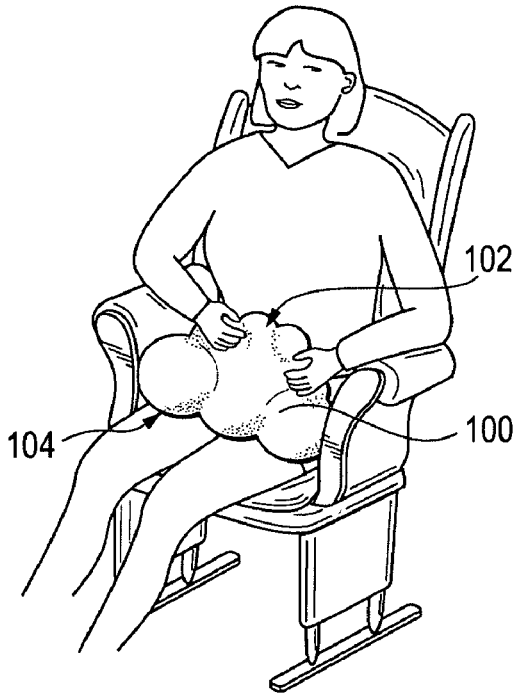
FIG. 4 illustrates one method of using a nursing aid device of the present invention.
Figure 5:
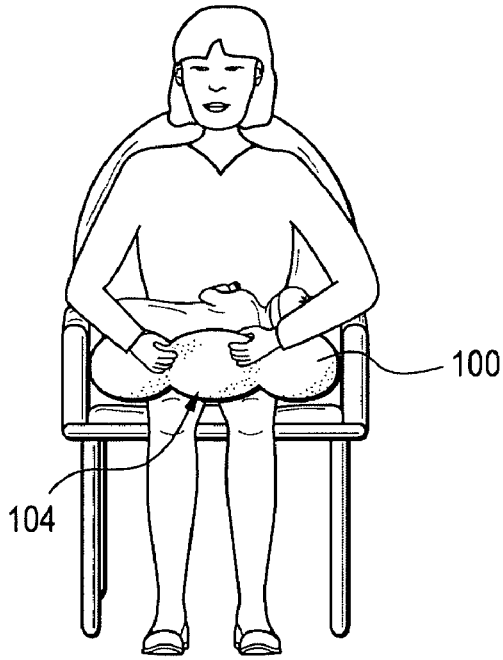
FIG. 5 illustrates another method of using a nursing aid device of the present invention.

In addition to these dimensions, the nursing aid device 100 in other embodiments may have different dimensions so long as the trapezoidal shape of the nursing aid device 100 is maintained. Unlike present nursing pillows designed to be positioned around a mother's torso, the nursing aid device 100 of the present invention is sized to fit on the mother's lap and if desired between the arms of a glider or rocking when she is sitting in the chair, as seen in FIG. 4. By being configured to fit within the arms of a glider or rocking chair and on the mother's lap, the nursing aid device 100 provides improved support for a baby when the mother is holding the baby while sitting in the chair. Preferably, the nursing aid device 100 has a thickness that enables the baby to be positioned at a plane substantially the same as the top of the arms of the chair, thereby supplying continuous support for the baby across the top of the arms and the mother's lap, as seen in FIG. 5.

Turning back to FIG. 2, the sides of the nursing aid device 100 may incorporate an undulating shape or pattern. In embodiments with sides having an undulating pattern, the undulating pattern serves to provide additional comfort during use by enabling the nursing aid device 100 to more snugly fit in a mother's lap.

Figure 3:
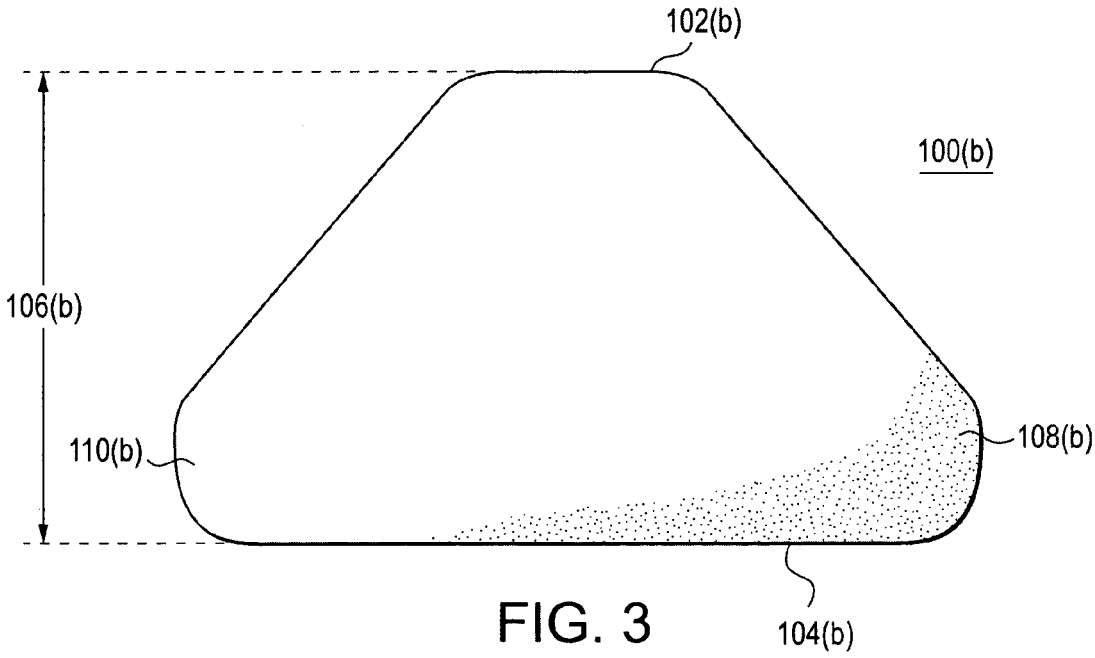
FIG. 3 illustrates another embodiment of a nursing aid device of the present invention.

FIG. 3 illustrates another embodiment of the present invention, nursing aid device 100(*b*), that does not incorporating sides having an undulating shape or pattern. As with nursing aid device 100, nursing aid device 100(*b*) is preferably trapezoidal in shape. A short length 102(*b*) of the nursing aid device 100(*b*) has a smaller length than a long length 104(*b*) of the nursing aid device 100. Similar to nursing aid device 100, the short length 102(*b*) of the nursing aid device 100(*b*) may measure approximately 10 inches in length while the long length 104(*b*) of the nursing aid device 100(*b*) may measure approximately 20 inches in length. The short length 102(*b*) and the long length 104(*b*) are generally parallel to each other, and there is a width 106(*b*) between the short length 102(*b*) and long length 104(*b*). Additionally, the long length 104(*b*) defines first and second wings 108(*b*), 110(*b*) of the nursing aid device 100(*b*). The dimensions of the nursing aid device 100(*b*) may be relatively the same dimensions of the nursing aid device 100.

With respect to the methods for using the nursing aid devices of the present invention, the methods describe the use of any nursing aid devices disclosed or within the scope of the invention, unless otherwise noted. For example, descriptions of methods with reference to nursing aid device 100 are also intended to encompass the use of nursing aid device 100(*b*), and references to elements of nursing aid device 100 are intended to encompass corresponding elements of nursing aid device 100(*b*).

Figure 6:
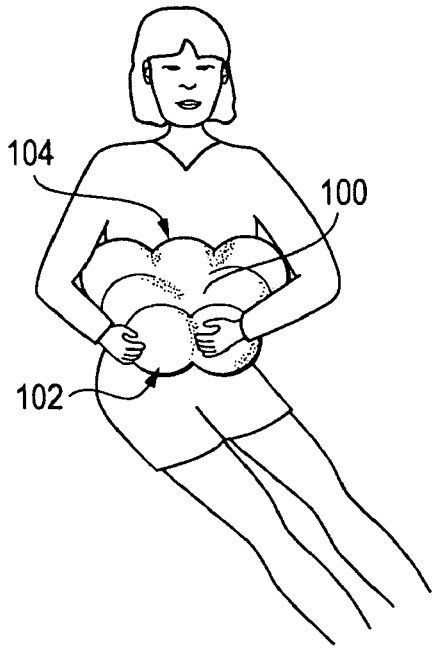
FIG. 6 illustrates a method of using a nursing aid device of the present invention.

FIG. 6 illustrates one method for using the nursing aid device 100. With this method of use, the mother is in a sitting position. The short length 102 of the nursing aid device 100 is placed in the mother's lap and over the Cesarian section incision, and the long length 104 of the nursing aid device 100 is oriented across the mother's stomach and under her arm. With this method, the long length 104 of the nursing aid device 100 provides support for the mother's arm while nursing and holding the infant to her breast. As the infant lies across the nursing aid device 100, the nursing aid device 100 evenly distributes the infant's weight across the incision area to reduce the discomfort felt by the mother while she is nursing. As a result, the mother's arm is supported and nursing is made more comfortable for the recovering mother. The child is also nestled on the nursing aid device 100 thereby providing comfort for the infant as well. When the mother switches the baby to the other breast (or other side), she can simply move the nursing aid device 100 across her body to support her other arm and continue to hold the baby on the nursing aid device 100 without fear of the infant pressing or pulling on the incision area.

Figure 7:
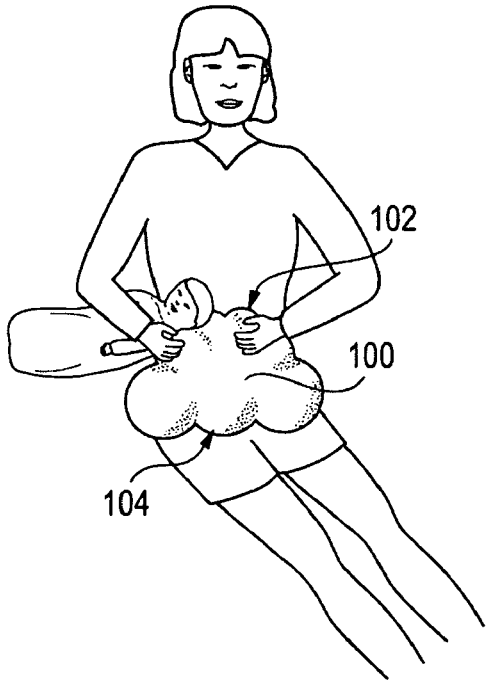
FIG. 7 illustrates another method of using a nursing aid device of the present invention.

FIG. 7 illustrates another method for using the nursing aid device 100. Here, the nursing aid device 100 is used to implement a "football hold." The "football hold" is one recommended method of nursing for mothers who have had Cesarian sections. This hold is often recommended because mothers have a difficult time holding the infants on their laps over the incision area. When implementing the "football hold," the nursing aid device 100 provides additional support and comfort for the mother and child thereby facilitating a mother's efforts to hold an infant more comfortably on her lap. Here, the nursing aid device 100 is placed on the mother with the long length 104 over the Cesarian section incision and the short length 102 towards the mother's chest. The baby is held within the crook of the mother's arm while the slope of the nursing aid device 100 supports the infant's back and the mother's arm while holding the infant to the breast. The nursing aid device 100 continues to provide support and coverage for the Cesarian section incision. When the mother switches to the other breast (or other side), the nursing aid device 100 remains over the incision and the child is moved to the other arm with the slope on the other side of the nursing aid device 100 supporting the infant's back. Here, the nursing aid device 100 provides support for the mother's arm as well as for the baby during nursing.

With another method of the present invention, the nursing aid device 100 is used to alleviate discomfort caused by a Cesarian section. For example, after having a Cesarian section procedure, coughing, laughing, or sneezing increases discomfort in the area of the incision due to stress being placed on the stitches of the incision. To alleviate this discomfort, the nursing aid device 100 may be positioned over the incision and the mother may hold the nursing aid device 100 in place by placing an arm on the first wing 108 and the other arm on the second wing 110. With this method, the mother may exert pressure down on the incision, by pressing down on the first and second wings 108, 110, while coughing, laughing, or sneezing in order to minimize the stress on the stitches of the incision during these acts. Placing downward pressure on the incision by holding the nursing aid device 100 over the incision limits the stress that may be placed on the incision stitches during a cough, laugh, or sneeze.

If the mother has an older child or toddler, the nursing aid device 100 may be used for support when sitting with or holding the other child as well. The older child cannot see the incision, but the mother can hold the nursing aid device 100 over the incision with the short length 102 snuggly between her legs in her lap and the long length 104 resting across her stomach. This will help the older child or toddler have a visual reference as to where not to touch or push near the incision.

While the invention is susceptible to various modifications and alternative forms, specific examples thereof have been shown in the drawings and are herein described in detail. It should, however, be understood that the invention is not to be limited to the particular forms or methods disclosed, but to the contrary the invention covers all modifications, equivalents, and alternatives falling within the spirit and scope of the appended claims.

What is claimed is:

1. A method of using a nursing aid device that is generally trapezoidal in shape comprising:

placing the nursing aid device on a mother's lap but not around her torso, the nursing aid device comprising a covering having short length, a long length opposite and generally parallel to the short length, and a wing on each end of the long length, and a filling comprising a soft material within the covering;

positioning the short length of the nursing aid device over a Cesarian section incision;

positioning the long length of the nursing aid device across the mother's stomach and under the mother's arm; and supporting the mother's arm with the nursing aid device while nursing a child.

2. The method of claim 1, further comprising distributing the child's weight across the incision using the nursing aid device.

3. The method of claim 1, wherein the covering comprises an outer periphery comprising a plurality of undulating curves.

4. A method of using a nursing aid device that is generally trapezoidal in shape comprising:

placing the nursing aid device on a mother's lap but not around her torso, the nursing aid device comprising a covering having short length, a long length opposite and generally parallel to the short length, and a wing on each end of the long length, and a filling comprising a soft material within the covering;

positioning the long length of the nursing aid device over a Cesarian section incision;

orienting the short length of the nursing aid device towards the mother's chest; and supporting a child's back with the nursing aid device while holding the child within the crook of the mother's arm.

5. The method of claim 4, wherein the covering comprises an outer periphery comprising a plurality of undulating curves.

* * * * *